US006905109B2

(12) United States Patent
Mills

(10) Patent No.: US 6,905,109 B2
(45) Date of Patent: Jun. 14, 2005

(54) STIFFENING DEVICE FOR PLASTIC FENCES

(76) Inventor: Richard E. Mills, 20 Chestnut, Unit #107, Wyandotte, MI (US) 48192

( * ) Notice: Subject to any disclaimer, the term of this patent is extended or adjusted under 35 U.S.C. 154(b) by 30 days.

(21) Appl. No.: 10/464,275

(22) Filed: Jun. 18, 2003

(65) Prior Publication Data

US 2004/0256609 A1 Dec. 23, 2004

(51) Int. Cl.[7] ..... E04H 17/00
(52) U.S. Cl. ..... 256/65.02; 256/65.12
(58) Field of Search ..... 256/65.02–65.03, 256/65.12, 59, 19; 403/169–171, 174

(56) References Cited

U.S. PATENT DOCUMENTS 2,815,972 A * 12/1957 Lagervall ..... 256/65.12 X
5,161,783 A * 11/1992 German ..... 256/19
5,349,800 A * 9/1994 Peng ..... 403/174 X
5,702,090 A 12/1997 Edgman
5,938,184 A 8/1999 DeSouza
6,679,481 B2 * 1/2004 McNalley et al. ..... 256/65.12
2003/0230745 A1 * 12/2003 McNalley et al. ..... 256/65.12

* cited by examiner

*Primary Examiner*—John R. Cottingham
(74) *Attorney, Agent, or Firm*—Brooks Kushman P.C.

(57) ABSTRACT

Plastic fences where rails are inserted into holes in hollow posts are effectively stiffened by inserting into the hollow post a stiffening device which grips the rails extending into the post, and which is stabilized against movement so as to prevent angular deflection of the rails with the posts in a plane orthogonal to the longitudinal axis of the post.

18 Claims, 4 Drawing Sheets

Fig. 1
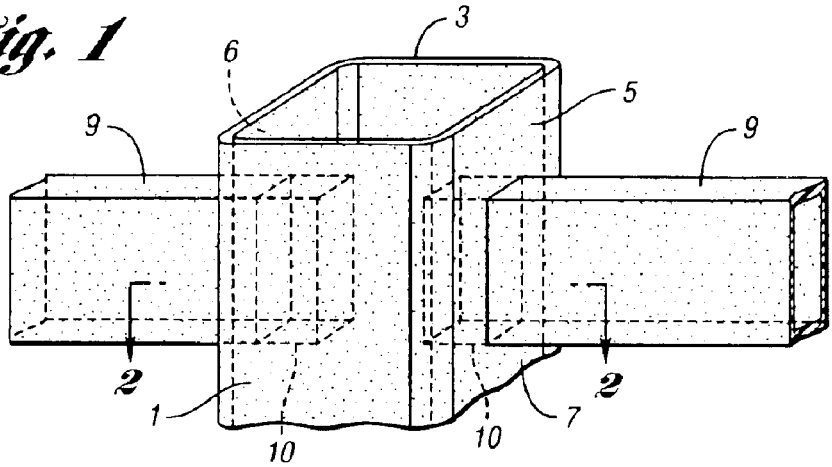
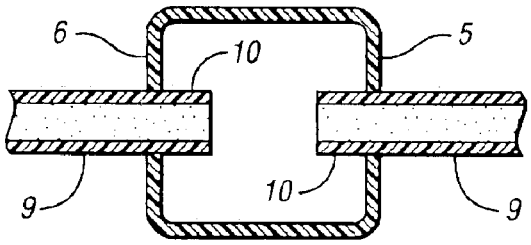
Fig. 2
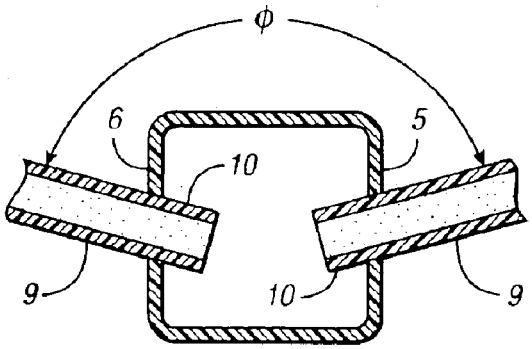
Fig. 3
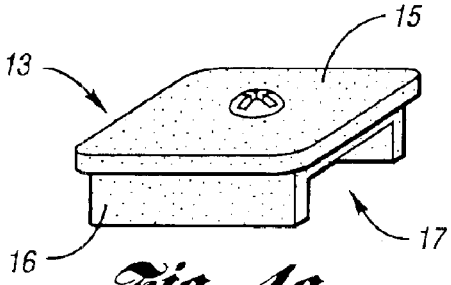
Fig. 4a
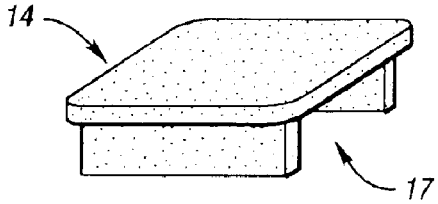
Fig. 4b

STIFFENING DEVICE FOR PLASTIC FENCES

BACKGROUND OF THE INVENTION

1. Field of the Invention

The present invention is directed to the field of plastic fencing.

2. Background Art

Plastic fencing has made severe inroads on traditional wooden fencing, and many miles of plastic fencing are installed each year. While there are numerous styles of fencing, one popular style consists of hollow posts which are sunk in the ground, with or without the aid of cement, or in the case of decks, mounted on special mounting bases. Spanning the gap between the posts are one or more horizontal rails. These rails may be unadorned, or vertical members may be attached to form solid fences, picket fences, etc. Numerous styles are possible.

Assembly of the fence requires the rails to be secured to the posts. For this purpose, metal brackets may be used, as disclosed in U.S. Pat. No. 5,938,184. However, this method of assembly is time consuming and results in an observable bracket which therefore fails to mimic a traditional wooden fence. Thus, more commonly, the posts are supplied with holes into which the rails pass. The holes may be manufactured into the post by the manufacturer or cut on the job site. A typical post/rail assembly is shown in FIGS. 1 and 2. In FIG. 1, a post and rail assembly is illustrated from the side. The post 1 in this case is a square post with walls 3 which may typically be about 0.25 inch thick. On faces 5 and 6, are rectangular holes 7 for receiving a fence rail 9. The rail end 10 protrudes some distance into the interior of the post. A section across 2—2 is shown in FIG. 2.

A problem with post/rail systems such as those of FIGS. 1 and 2 is that the fences exhibit a considerable amount of "wobble," even when posts are set in concrete. The reason for this wobble has to do with a lack of rigidity due to the fact that the rails are free to move within their holes in the post, as shown in FIG. 3, the same structure as depicted in FIG. 2, but with a sidewards force imposed upon the structure. The rails, rather than being spaced 180° apart, now make an oblique angle with respect to each other. In long runs of fences, these problems are exacerbated.

In U.S. Pat. No. 5,702,090, rather than extend into the post through its sidewall, rails are captured by a recess, which also serves to hold a framing member for vertical slats. However, the recess is too shallow to cause any appreciable stiffening of the fence line. Moreover, this construction requires a more complex extruded post, one which also fails to mimic traditional wooden fencing, and requires greater accuracy during installation, as spacing is critical.

It would be desirable to provide a plastic fencing system which is economical, easy to install, and which has a much reduced tendency to wobble. Such a system would employ simple post/rail systems where the rails are inserted through holes in the post, while yet forming a robust assembly.

SUMMARY OF THE INVENTION

The inventor has surprisingly discovered that wobble in plastic fencing can be much reduced without undue complexity, by inserting over the penetrating rail ends, a stiffening member which grips the rail ends and itself is prevented from moving within the hollow post. The stiffening member is preferably a U-shaped channel which slips over the inwardly extending rail ends.

BRIEF DESCRIPTION OF THE DRAWINGS

FIG. 1 illustrates one type of plastic fencing, from the side;

FIG. 2 is a top view of FIG. 1 across 2—2;

FIG. 3 illustrates post/rail deflection in a fencing of FIGS. 1 and 2;

FIGS. 4*a* and 4*b* illustrate two preferred embodiments of the subject invention stiffening devices;

DETAILED DESCRIPTION OF THE PREFERRED EMBODIMENT(S)

The stiffening devices of the present invention comprise a rail gripping means or element and a stabilizing means or element, as described in greater detail hereafter.

The rail gripping means or rail gripping element serves to grip, or "locate," the end of a rail protruding into a post, most preferably two or more rail ends. It is more important that the ends of the rail be gripped as opposed to the portions of the rails just inside the post, as gripping the rail ends will have the greatest effect in reducing wobble. However, it is preferable that a substantial portion or all of the rail protruding into the post will be gripped, and in some designs, a portion of the rail just inside the post may be the sole portion of the rail gripped. The gripping means may constitute a plurality of narrow fingers which will slip over the rails, but is preferably an inverted U-section piece of metal or plastic, preferably plastic, as shown in FIGS. 4*a* and 4*b*. The rail gripping means or element may receive the rail ends with some degree of clearance, or may engage the rail in a spring-like or "interference fit" manner. The rail gripping means or element serves to locate the tail or rails in the desired location within the post.

The stiffening device also includes a stabilizing means or element. By "stabilizing" is meant reducing the number of degrees of freedom of movement of an assembly of one or more rail ends within a post, in combination with rail gripping means. The motion desired to be most eliminated is not vertical motion, but motion in a horizontal plane, particularly angular motion as shown in FIG. 3. Such motion, for example, would ordinarily be produced by leaning against a fence or post, or by wind impinging upon the fence.

The stabilizing means will comprise a means for stably locating the rail gripping means within the post, such that angular or sidewards motion is reduced. In combination, the rail gripping means and stabilizing means substantially reduce wobbling. The stiffening devices may be applied over only the top rail, or may, when suitably configured, be applied over a second, lower rail, or a bottom rail. However, it is the topmost rail or rails for which wobbling is the greatest problem. As the stiffening device functional elements are contained solely within the post (with the exception of any embodiments employing a decorative cap), the traditional appearance of the fencing is maintained.

The stiffening devices will now be described in greater detail by referring to numerous embodiments, as depicted in FIGS. 4–12.

Figure 4C:
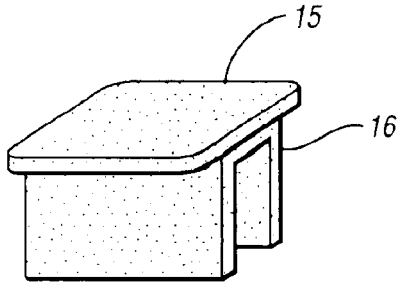
FIG. 4*c* illustrates a device such as one of FIGS. 4*a* or 4*b* being inserted into a hollow post, over rails extending into the post.
Figure 5:
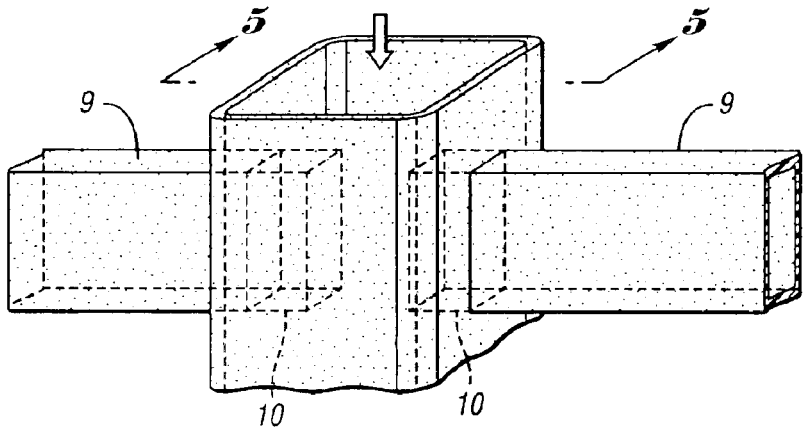
FIG. 5 illustrates a section across 5—5 of FIG. 4*c;*
Figure 5:
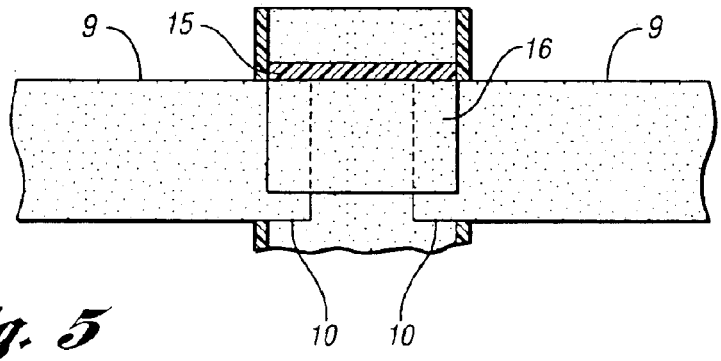

In FIGS. 4*a* and 4*b*, preferred embodiments are shown in perspective. In FIG. 4*a*, the stiffening device 13 comprises two pieces, a roughly square top piece 15 (in a hollow round post this top piece would preferably also be round) which serves as a stabilizing means, and a generally U-shaped channel 16 which serves as the rail gripping means. The two pieces, preferably of plastic, are affixed to each other in this embodiment, preferably by a screw or other fastener. The size of the interior of the channel 17 is selected so as to grip the rails, or to slip over the rails with only minimal clearance, since greater clearance will allow more wobble. In FIG. 4*a*, although a screw fastener is shown, the two pieces may be fusion bonded, adhesively bonded, or may, as shown in the stiffening device 14 of FIG. 4*b*, be molded or extruded as a single unit. FIG. 4*c* illustrates placement of the stiffener 13 in the post/rail assembly, where the stiffener is merely inserted into the cavity in the post, with the rail gripping means 16 sliding over the inner portions 10 of the rails. A detail across 5—5 is shown in FIG. 5. The roughly square top of the stiffening device is not free to rotate or to move appreciably sideways, and thus stabilizes the position of the rail gripping means.

Figure 6:
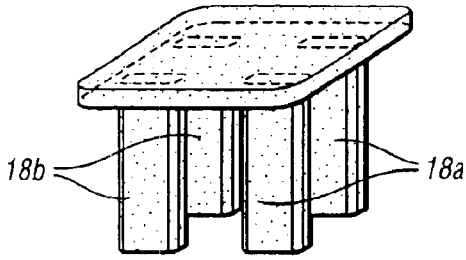
FIG. 6 illustrates a further embodiment of a stiffening device of the present invention.

FIG. 6 illustrates a less preferred stiffening device, where the rail gripping means comprises two pairs 17*a*, 17*b* of downwardly extending fingers, spaced inwardly from the sidewall of the post, so that inner portions of the rail ends may be gripped.

Figure 7:
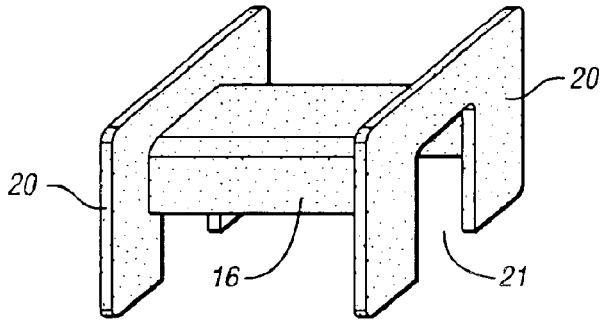
FIG. 7 illustrates a yet further embodiment of a stiffening device of the present invention.

FIG. 7 illustrates an alternative embodiment of a stabilizing means, where a U-shaped channel 16 is located between two end-plates 20, separated by a distance such that they may fit between the post walls. The U-shaped channel is shown extending only part way down the end plates, the latter having an open area 21 to facilitate locating over the rails. However, the channels may also extend further, or all the way down the end plates.

Figure 8:
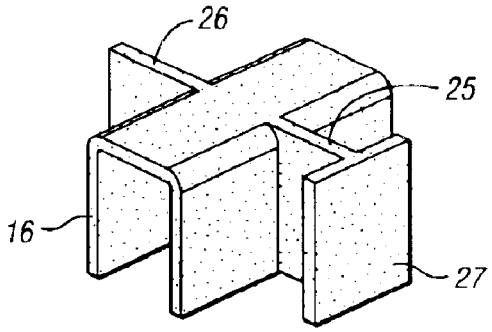
FIG. 8 illustrates another embodiment of a stiffening device of the present invention.

Further devices are illustrated in FIG. 8, where a U-shaped channel 16 is molded with two sidewards extending stabilizers 25, 26. The stabilizer shown at 26 simply extends outward to contact or be in close proximity to the post interior wall. In devices of this type, having a stabilizer of the type 26 extending away from each side of the U-shaped channel 16, the part of the channel most prone to sideways movement, i.e. in the center of the post, is constrained against movement by the stabilizing means abutting the post walls. A somewhat stiffer device even less prone to movement is a device of FIG. 8 where two stabilizers 25 are employed, these stabilizers having an extension 27 which allows greater contact area with the post wall.

Figure 9:
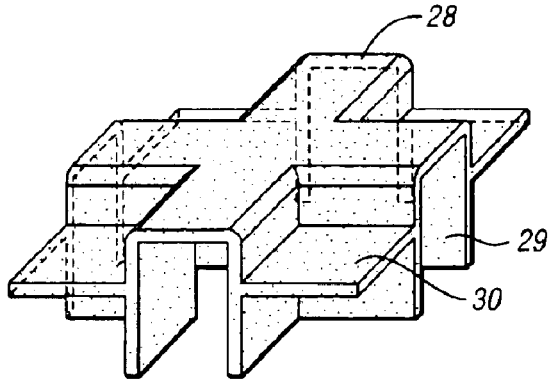
FIG. 9 illustrates a dual channel device which may be used universally for straight T, or X fences.
Figure 10A:
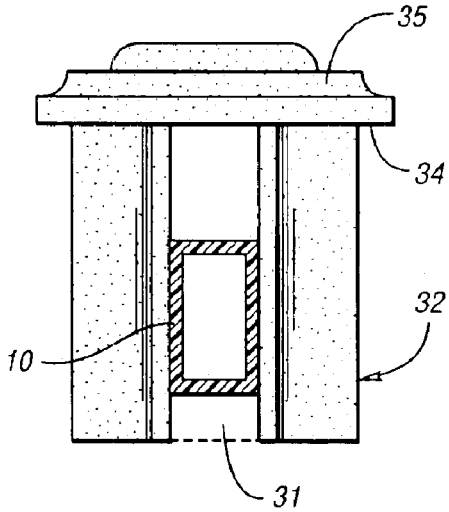
FIGS. 10*a* and 10*b* illustrate a stiffening device which includes a decorative post cap.
Figure 10B:
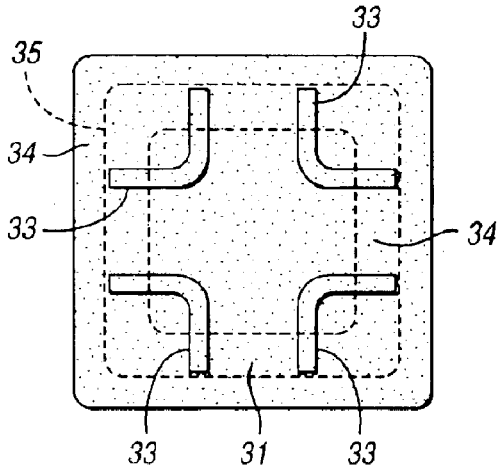

Yet further devices, of preferred construction, are shown in FIGS. 9 and 10*a* and 10*b*. In FIG. 9, two intersecting U-channels allow stabilizing not only linear fences, but fences where a "T" or "X" meeting of fence lines occur. These may be at right angles, or at other angles as well. In FIG. 9, two intersecting U-channels 28 and 29 are molded integral with a stabilizing plate 30 around a waist section of the device. The stabilizing plate may also be moved to the bottom (open end) of the U-shaped channels, towards the top, or may form a top plate as shown in FIG. 4*b*. An advantage of the device of FIG. 9 is increased stiffness. A further advantage is the ease of inserting into the post, since the uppermost portions of the channels above the waist stabilizer element may be easily gripped.

The device of FIG. 10*a* is similar to the device shown in FIG. 9 but has been elongated and topped with a decorative cap 35. The device of FIG. 10*a* has two intersecting rail receiving channels 31, 32 extending downwards from the decorative cap 30. The length of the channels is such that they abut or at least are in close proximity to the post interior walls, thus serving as both rail gripping means and stabilizing means. The same device is shown from the bottom in FIG. 10*b*. The channels 31, 32 are formed by angle sections 33 projecting away from the decorative cap. In use, the rails are placed in position in the post, and the combination device is pressed down into the post cavity, surrounding at least part of the rail or rails, until the bottom flange 34 of the device cap contacts the post.

Figure 11A:
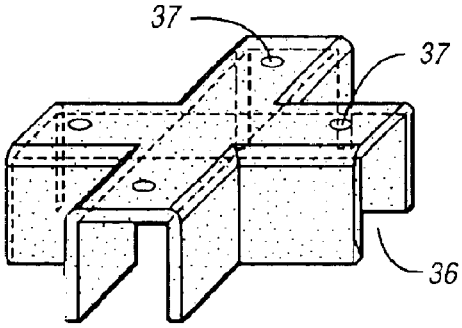
FIGS. 11*a* and 11*b* illustrate multiple-way stiffening devices wherein channels at angles to each other serve as rail receiving elements and stabilizing elements.
Figure 11B:
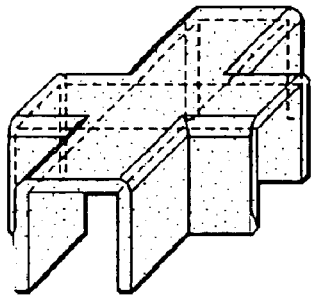

A further preferred embodiment of a device of the subject invention is shown in FIGS. 11*a* and 11*b*. In the device of FIG. 11*a*, which may be used with one to four, preferably two to four rails, the intersecting channels 35, 36 extend to the inside walls of the post, and serve as both the rail gripping means and stabilizing means. Each channel is capable of gripping one or two rails entering the post from opposite sides, whereas for each channel, the channels at right angles serves to stabilize the other channel against rotation, twisting, etc.

A somewhat similar device is shown in FIG. 11*b*, however, one of the channels does not extend to the wall of the post, while the other does. In a linear fence, the short channels would be placed over the opposing rails, and the long U-channels would stabilize the device against twisting by contacting or being in close proximity to the interior wall of the hollow post.

From the above descriptions of numerous embodiments, which are illustrative and not limiting, the bounds of the invention are easily ascertained. The subject invention devices include at least one portion of the device which grips or receives at least one and preferably two rails, and a portion, which may be the same or a different portion from the first portion, which serves to minimize motion, flexion and/or rotation of the device in the post, particularly in a plane orthogonal to the longitudinal axis of the post. The structure of the device may range from a simple U-channel with thick sidewalls, whose open end abuts the wall of the post, to the more complex designs illustrated herein. The device is amenable for use in posts which are square, rectangular, polygonal, round, or are of other shapes. As a further aid in stiffening the fences, the stiffening devices may be adhered to the rails, for example by conventional PVC bonding compositions, in the case of PVC rails. However, in the latter case, disassembly of the fence to replace broken rails, etc. will be difficult. Hence, it is more desirable to secure the stiffening devices to the rails by fasteners such as rivets or screws, etc. A device which is manufactured with holes 37 for this purpose is shown in FIG. 11. Holes may be manufactured into the remaining devices as well. Alternatively, holes may be drilled in the field, particularly with devices of preferred plastics constructions, where drilling is easy and rapid.

The devices may be made of metal, thermoplastic, or thermosetting resin, and may be filled and/or fiber reinforced. Preferred devices are injection molded of an injection moldable thermoplastic such as polyethylene, polypropylene, polyamide, polystyrene, polyacetal, polyvinyl chloride ("PVC"), thermoplastic polyurethane, etc. Preferably, the thermoplastics are unfilled, or are filled with conventional fillers, and may also contain short lengths of reinforcing fibers, e.g. fiberglass. The devices may also be made of thermoset materials such as sheet molding compound, epoxy resin, polyester resin, thermoset polyurethane, e.g. polyurethane RIM, and the like. Due to increased cost, metal devices are not preferred, although they are suitable. Preferably, the devices are of filled or unfilled thermoplastic, such as polyamide, polyolefin, or PVC, most preferably polypropylene or PVC.

Figure 12:
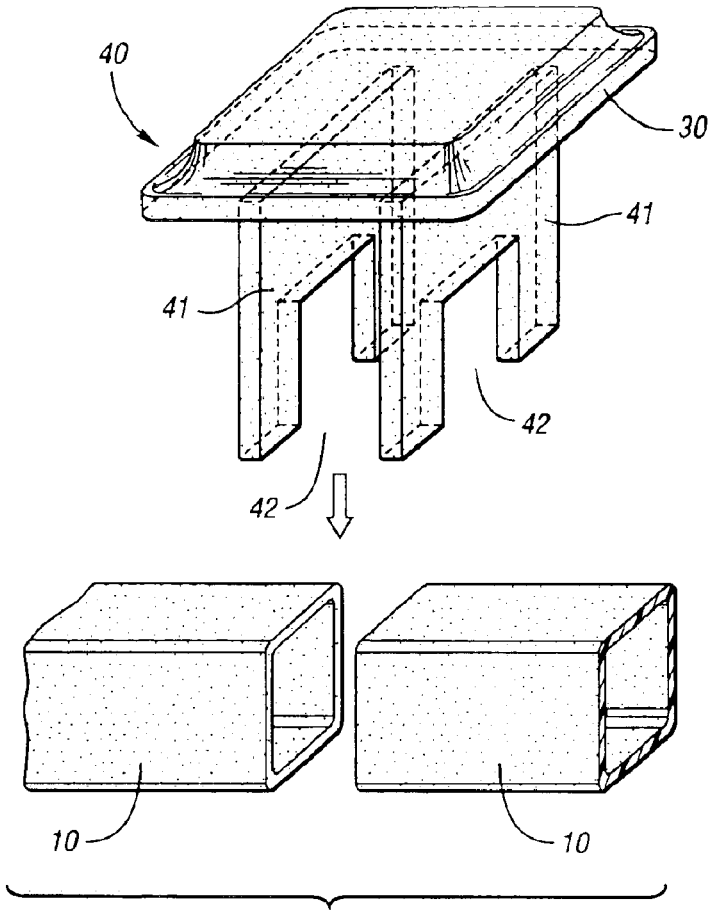
FIG. 12 illustrates a yet further embodiment of a subject invention stiffening device.

The preferred rail gripping means or elements are simple channels, either produced separately, as shown in FIG. 4*a*, or molded integrally, as shown in FIGS. 4*b*, 11, etc. While the devices have often been described in terms of "U-channels," channels of any section which suitably provide the rail receiving function are suitable, for example, but not by limitation, "C-channels," "J-channels," etc. Fingers or partitions, which are roughly equivalent to "short channels" may also be used, as illustrated by FIG. 12, which includes a decorative cap 30, and two partitions 41 which extend to or proximate the interior of the sidewall of the hollow post. The stiffening device 40 is inserted into the post (not shown), recesses 42 in the partitions 36 slipping over the rails 10.

Figure 13:
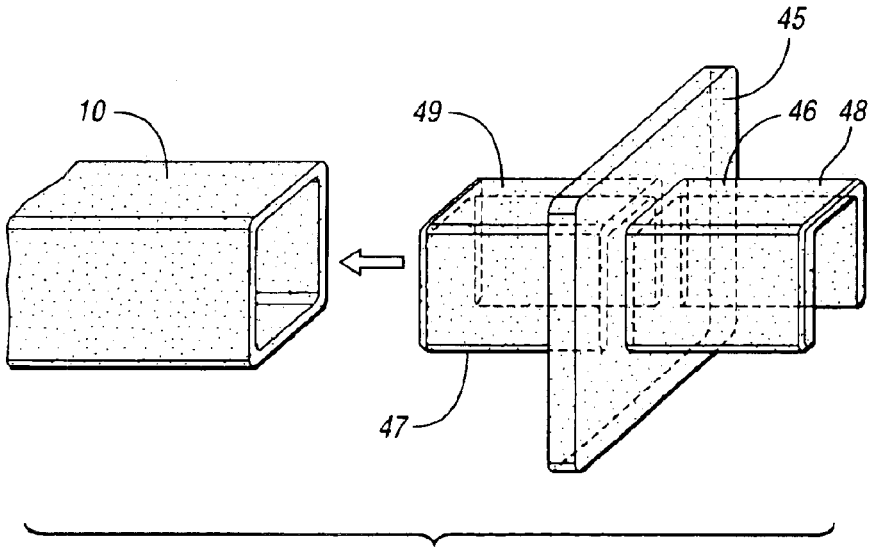
FIG. 13 illustrates a further embodiment of a subject invention stiffening device where rail gripping elements extend into hollow rail ends.

Further embodiments are easily envisioned. For example, while the rail gripping elements have been shown as channels which fit over the rails, devices which grip the hollow rails from within are also within the scope of the invention. One such embodiment is shown in FIG. 13, where a vertical stabilizing element 45 is sized to fit between opposing hollow post walls, and is fitted with two extensions 46,47 which are sized to fit within post rail ends, e.g. extension 47 fitting within hollow post rail end 10. The extensions may be solid, but are preferably of hollow construction to minimize material usage. The ends may be open as shown (U-shaped) or closed, and are preferably tapered at the ends 48,49 to facilitate entry into the ends of the rails. In this embodiment, the stiffening device is inserted prior to insertion of one or both rails. An analogous stiffening device where extensions penetrate into the rail ends may be configured for a "T" or "X" configuration (3 or 4 rails, or 2 rails at an angle), but dispensing with the stabilizing plate 45 and adding two extensions at an angle (e.g. a right angle) to extensions 46 and 47, as for the external combination gripping and stabilizing device shown in FIG. 11*a*, but with the extensions sized to fit within rather than over the rails. One set of extensions serves as a stabilizer to the other set of extensions.

The depth which a channel or other locating or rail gripping means must have will be dependent upon other factors such as the post internal diameter and the nature of the stiffening device itself. For stiffening devices without a top plate (as shown in FIGS. 4*a* and 4*b*); a waist plate (see FIG. 9) or a bottom plate as described previously, it is desirable that the rail gripping elements be of considerable depth, e.g. preferably from about 0.15 to 1.0 or greater of the height of the rail, more preferably from about 0.20 to about 0.75 of the height of the rail. With more inherently stiff and stable stiffening devices, lesser depth will be required. Since fences are often installed on non-planar surfaces, e.g. hills, gulleys, rolling pasture, etc., some allowance may be made for rails which enter the post at an angle to the horizontal. A relatively deep channel or partition (as shown in FIG. 12) can be made to accommodate substantial differences in rail angle in a vertical plane while still providing adequate rail location.

While the majority of fences are linear, or have projections at right angles, some fences must curve gradually or angle abruptly at other than 90° angles. Custom stiffening devices may be provided, or may be made in the shop or in the field, for example following the construction of FIG. 4*a* but with two channel pieces at the correct angle to each other, secured to the top piece by fasteners and/or adhesive, etc.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fence stiffening device for use in post and rail fence systems wherein at least one rail is inserted through a hole in a hollow post and extends into the interior of the post, said device comprising:

a) a rail gripping element effective to locate the rail extending into the hollow post, said rail gripping element open on bottom surfaces thereof such that said fence stiffening device is insertable over said rail after said rail has been inserted into said hollow post; and b) a stabilizer connected with the gripping element which minimizes movement of the rail and the rail gripping element within the post, said device of a size such that the rail gripping element fits within the hollow post.

2. The device of claim 1, wherein said rail gripping element comprises a rail receiving channel, open on its bottom side.

3. The device of claim 1, wherein said rail gripping element comprises a rail receiving channel which extends from one interior wall of said post to an opposite interior wall of said post.

4. The device of claim 1, wherein the gripping element comprises a first channel, and a second channel in the same plane as the first channel, but at an angle thereto.

5. The device of claim 1, wherein the gripping element comprises at least one U-shaped channel, and wherein the stabilizer extends outward from said channel to walls of said post.

6. The device of claim 5, wherein said stabilizer comprises a flat portion of plastic, and wherein the gripping element comprises a U-channel integral with or adhered to one side of the stabilizer.

7. The device of claim 1, wherein the stabilizer comprises two rail-receiving channels which intersect at right angles.

8. The device of claim 1, wherein the stabilizer comprises an integral decorative post cap for the post and wherein said rail gripping element is positioned below and attached to the stabilizer.

9. A method for installing a fence comprising hollow posts and rails extending therebetween, said method comprising:

extending at least one rail into a hollow post having an open top end; and introducing into said open top end of said post, a stiffening device of claim 1, such that said rail gripping element receives at least one rail end within said post.

10. The method of claim 9, wherein at least two rails enter said post from differing directions, and wherein said rail receiving element comprises a channel which receives said at least two rails.

11. The method of claim 9, further comprising fastening said rail receiving element to at least one rail by bonding and/or by using a fastener.

12. A post and rail fence system, comprising in combination:

at least one hollow post;

at least one rail extending through a side of said hollow post and into the interior thereof;

a fence stiffening device of claim 1.

13. The post and rail fence system of claim 12, wherein said stiffening device comprises a single open side channel, the width of the channel such that said rail fits within said channel, and said channel surmounted on a side opposite said open side with a generally flat stabilizer which extends to the interior walls of said post.

14. The post and rail fence system of claim 12, wherein said stiffening device comprises two intersecting open sided channels, the width of the channels such that said rail fits within said channel.

15. The post and rail fence system of claim 14, wherein said stiffening device further comprises a generally flat stabilizer which extends to the interior walls of said post.

16. The post and rail fence system of claim 14, wherein said two intersecting open channels comprise a single molding of plastics material.

17. The post and rail fence system of claim 15, wherein said two intersecting open channels and said generally flat stabilizer are a single molding of plastics material.

18. A post and rail fence system comprising: a hollow post having an interior and a hole;

a rail inserted through the hole in the post; and a fence stiffening device comprising:

a) a rail gripping element effective to locate the rail extending into the hollow post; and b) a stabilizer connected with the gripping element which minimizes movement of the rail and the rail gripping element within the post, said device of a size such that the rail gripping element fits within the hollow post and wherein the gripping element comprises a first channel, and a second channel in the same plane as the first channel, but at an angle thereto.

* * * * *

UNITED STATES PATENT AND TRADEMARK OFFICE

CERTIFICATE OF CORRECTION

PATENT NO. : 6,905,109 B2
DATED : June 14, 2005
INVENTOR(S) : Richard E. Mills

It is certified that error appears in the above-identified patent and that said Letters Patent is hereby corrected as shown below:

Column 6,
Line 38, after "post," take a new line for "said device".

Column 8,
Line 19, after "post," take a new line for "said device".

Signed and Sealed this

Thirteenth Day of September, 2005

JON W. DUDAS
*Director of the United States Patent and Trademark Office*